US008109863B2

(12) United States Patent
Gilberti et al.

(10) Patent No.: US 8,109,863 B2
(45) Date of Patent: Feb. 7, 2012

(54) RESISTANCE EXERCISE TRAINER AND RELATED SPEED TRAINING PROCESS

(75) Inventors: Christopher Gilberti, West Los Angeles, CA (US); Cyril Brizard, Topanga Canyon, CA (US); Monte L. Nash, Santa Maria, CA (US)

(73) Assignee: All Sports Conditioning, Inc., West Los Angeles, CA (US)

( * ) Notice: Subject to any disclaimer, the term of this patent is extended or adjusted under 35 U.S.C. 154(b) by 17 days.

(21) Appl. No.: 12/543,384

(22) Filed: Aug. 18, 2009

(65) Prior Publication Data

US 2010/0048363 A1 Feb. 25, 2010

Related U.S. Application Data

(60) Provisional application No. 61/090,819, filed on Aug. 21, 2008.

(51) Int. Cl.
*A63B 21/065* (2006.01)

(52) U.S. Cl. ..... 482/105; 473/438

(58) Field of Classification Search ..... 482/74, 482/93, 105, 128, 129, 910; 434/251, 255; 473/438, 441, 445; 190/102, 103, 115, 124
See application file for complete search history.

(56) References Cited

U.S. PATENT DOCUMENTS

| | | | | | |
|---|---|---|---|---|---|
| 1,577,077 | A * | 3/1926 | Huston | 482/105 |
| 2,237,600 | A | 4/1941 | Gilman | |
| 2,254,578 | A * | 9/1941 | O'Brien | 190/107 |
| 3,972,238 | A * | 8/1976 | Thatcher | 482/128 |
| 5,217,186 | A | 6/1993 | Stewart et al. | |
| 5,242,348 | A * | 9/1993 | Bates | 482/105 |
| 5,472,394 | A | 12/1995 | Michaelson | |
| 5,816,982 | A * | 10/1998 | Croushore | 482/55 |
| 6,149,555 | A * | 11/2000 | Kinback | 482/93 |
| 6,216,926 | B1 * | 4/2001 | Pratt | 224/153 |
| 6,261,194 | B1 | 7/2001 | Hadar et al. | |
| 6,601,743 | B2 * | 8/2003 | Godshaw | 224/153 |
| 6,942,585 | B1 | 9/2005 | Krause | |
| 6,994,658 | B2 * | 2/2006 | Laudenslager et al. | 482/83 |

* cited by examiner

*Primary Examiner* — Loan Thanh
*Assistant Examiner* — Tam Nguyen
(74) *Attorney, Agent, or Firm* — Kelly Lowry & Kelley, LLP

(57) ABSTRACT

The resistance exercise trainer includes an adjustable strap wearable by a user, a leash attached to the strap at a first end and a bag attached to a second end of the leash and configured for removable reception of at least one weight. When wearing the strap and pulling the bag and the weight with the leash, the weighted bag impedes user movement thereby providing resistance exercise training. As part of the resistance exercise training, the leash may be disconnected from the strap and used individually as a jump rope and the weight may be removed from the bag and used individually in strength training exercises. Together, the strap, the leash, the bag and the weight may be used in a speed training triangle.

20 Claims, 13 Drawing Sheets

RESISTANCE EXERCISE TRAINER AND RELATED SPEED TRAINING PROCESS

BACKGROUND OF THE INVENTION

The present invention relates to a resistant exercise trainer and related speed training process. More particularly, the present invention relates to a resistance exercise trainer kit having a durable bag capable of retaining multiple safe weights for use in a related speed training process that enhances athletic endurance, speed and strength.

The popularity of training devices designed to improve athletic performance such as strength, speed and endurance have increased in popularity in recent years for both professional and amateur athletes. Accordingly, a wide variety of equipment and training regimens have been devised for athletes having a variety of skill levels. Training equipment has been designed for athletes involved in a variety of sports that include soccer, football, hockey, track and field, basketball, baseball, swimming, etc. The training devices are devised to improve physical performance by applying a drag force, weight or other impedance to the athlete during an exercise or training regimen. The restraints are specifically designed to resist athletic movement. Thus, the athlete must exert a greater than normal muscular effort to perform the exercise or training regimen. Restraints of this kind are particularly popular for improving athletic strength, speed and endurance.

One example of such a training device includes strapping weights to an athlete prior to running. During training, the athlete must overcome increased forces from the weights to reach normal running speed. The athlete also experiences a greater physical load over the duration of the entire training session. Once removed, the athlete may achieve higher speeds and longer distances since the body experiences less resistance and less work load due to the absence of the weights. Other athletes may use weighted sleds or skids that must be pushed or pulled in order to obtain additional resistance. For example, a cord extending from a sled connects to a belt strapped to an athlete. The athlete pulls the sled while running across an artificial turf or natural field. The athlete must exert a greater than normal muscular effort to drag the additional weight across the field. Alternatively, athletes may push weighted skids. These are particularly popular in football where offensive or defensive linemen push tackling dummies attached to a weighted skid to improve blocking or tackling skills in addition to building strength, speed and endurance. But, appropriate weight selection, attachment, distribution of weight to the body, and formulation of training regimens with respect to the above-identified devices are difficult. Moreover, weights and large, heavy sleds or skids are relatively expensive, difficult to adjust, certainly uncomfortable to wear and are inconvenient to store and transport due to the requisite quantity, weight and size.

More recently developed techniques use wind or water resistance through the use of a strap-on chute that increases resistance by collecting air or water during running or swimming. More specifically, U.S. Pat. No. 5,217,186 to Stewart et al. discloses a parachute designed to resist forward motion. The parachute is square shaped and has a number of attached parachute cords drawn through a spacing disk that prevents the cords from tangling. The parachute attaches to the athlete by a strap extending from the cords. The parachute opens in the wind during running and exerts a drag force on the athlete. In general, resistance exerted on the athlete is a function of the size and shape of the inflated parachute. Athletes may also experience larger drag forces at higher speeds. But, the Stewart parachute suffers from an inability to predictably change the resistance of the parachute. Changing resistance is important especially since athletes vary in weight, height, and most importantly, strength. Individual athletes may also require different resistances during different portions of a training regimen. Hence, an athlete must acquire multiple parachutes, each varying in size and possibly shape, to accommodate the need for multiple resistances. Another drawback of the Stewart parachute design is that an athlete will experience larger resistances and higher drag on windy days. Additionally, depending upon the direction of the wind, it may be difficult for the athlete to even inflate the parachute to obtain any resistance. The square parachute design in Stewart also does not always adequately catch wind and stay inflated, particularly during turns. Other similar prior art parachute devices tangle easily and may be unstable in both straight movement and upon turning.

Another parachute design is disclosed in U.S. Pat. No. 5,472,394 to Michaelson, which endeavors to solve the problems associated with Stewart. Michaelson discloses a parachute for use in speed and endurance training for amateur or professional athletes. The parachute is usable during running, biking, skating, etc. The parachute includes a set of cords that attach to an edge of the parachute at one end and commonly attach together to a strap, e.g. a belt worn by the athlete, at the other end. A regulator alters the free length of the cords and the corresponding shape of the inflated parachute. In turn, the athlete may adjust the resistance of the parachute by adjusting the length of the cords. The parachute sheet itself is formed with air pockets extending radially out from near the center of the sheet and terminating at the cord attachment points. The drag afforded by the parachute is adjusted by the degree of the opening of the pockets and the size of the inflated parachute. Shortening the length of the cords decreases the size of the inflated parachute and decreases the maximum drag. Increasing the length of the cords correspondingly increases the size of the inflated parachute thereby increasing the maximum drag. While the Michaelson design improves on adjustability in view of Stewart, it still fails to take into account predictable and reliable resistance. Like Stewart, Michaelson cannot control environmental factors such as wind, which ultimately affects the resistance exerted on the athlete.

Alternative resistance-based athletic training devices used to improve athletic performance include the aforementioned sleds or skids. Football players in particular use blocking sleds to improve endurance, speed and skills such as blocking or tackling techniques. Blocking sleds typically have a large, broad base and include a dummy positioned at one end thereof. The player contacts the dummy and drives the sled backwards. The player must exert significant energy to move the heavy and cumbersome sled backwards. A person may stand on the rear platform to add additional resistance and weight to the sled.

In another example, U.S. Pat. No. 6,942,585 to Krause discloses a moveable football training sled having a blocking dummy mounted to a front portion of an elongated frame. The front portion is generally flat and angled relative to a tipped rear portion. A wheel is mounted rearwardly of the front portion and midway between laterally opposite sides of the frame. A player strikes the blocking dummy, tilts the front portion back about the wheel and drives the sled backwards. The size and weight of the frame and tackling dummy provide weighted resistance to the athlete moving the frame.

Moreover, U.S. Pat. No. 6,261,194 to Hadar et al. discloses a one man football blocking sled capable of being interconnected to form a multiple-man tackling sled. The one-man tackling sleds are connected together by a bar that extends through and locks into a channel rigidly attached to each sled.

Of course, increasing the number of connected sleds increases the weight of resistance of the training device. But, the multiple-man sled is designed to be used with multiple athletes. Accordingly, each athlete is assigned to "tackle" the corresponding dummy attached to each individual blocking sled. Thus, individual athletes will not experience an increase or decrease in resistance as other players using the tacking sled make up the difference in load.

Lastly, U.S. Pat. No. 2,237,600 to Gilman discloses a blocking sled having a set of runners secured to an upright arcuate member at one end. A spring secured above the lower portion of the arcuate member increases the resistance of the arcuate member in response to contact by the athlete. In this regard, the athlete drives into the arcuate member and forces the blocking sled rearwardly. Friction between the runners and the ground, and forces in the spring, provide the necessary resistance to work the athlete. Of course, the blocking sled includes padding on the free ends of the arcuate member driven by the athlete. This prevents physical contact of the athlete with the metallic arcuate member.

Unfortunately, the blocking or tackling sleds described above have several general drawbacks. For instance, the sleds are often expensive, difficult to move and require significant storage space relative to other training devices. While professional sports teams can typically easily afford such a training device, smaller football programs, such as a high school football program, may have difficulty raising the funds or finding the requisite storage space to house the training equipment. But, these training devices do reduce player-to-player contact and are particularly desirable because they reduce the number of injuries associated with contact between two players. Thus, athletes are able to train harder and longer without substantially increasing the risk of injury due to constant contact with other teammates.

There exists, therefore, a significant need for a versatile, safe and inexpensive resistance exercise trainer and related speed training process. Such a resistance exercise trainer should include a durable bag capable of storing one or more safe weights, should be attachable to a person, should provide relatively predictable resistance based on the quantity of safe weights in the bag and the surface along which the bag is dragged upon and should be easy to manufacture, inexpensive and compact. The present invention fulfills these needs and provides further related advantages.

SUMMARY OF THE INVENTION

The resistance exercise trainer generally includes an adjustable strap wearable by a user, a leash selectively attachable to the strap at a first end and a bag selectively attachable to a second end of the leash and configured for removable reception of at least one weight. The resistance exercise trainer provides resistance exercise training when a user wears the strap and pulls the bag and the weight with the leash such that the weighted bag impedes user movement. Impeding user movement in this regard is particularly useful for enhancing speed, strength and endurance.

More specifically, the strap may include a flexible belt, a harness or a vest designed to be selectively worn by the user. The strap may also include a selectively adjustable clip, hook and loop, buckle, tri-clip or a tri-glide that enables the resistance exercise trainer to selectively fit users that vary in size. The weight pulled by the strap and the leash preferably includes a low-impact filling designed to prevent injury upon impact. For example, the low-impact filling may include granules, pellets or low-density beads. In one embodiment, the low-impact filling is permanently heat sealed within the interior of the weight. In an alternative embodiment, the weight includes a sealable compartment for selectively filling or emptying the low-impact filling. In this embodiment, the compartment may include a sleeve that has a double reinforced zipper for forming an air and water tight seal. The leash itself may be configured for individual use as jump rope, while the weight may also be configured for individual use in weight lifting exercise. In this regard, the weight may further include a hand grip to increase the versatility of using the weight in associated strength training exercises.

The bag itself is preferably manufactured from a stretchable material capable of accommodating multiple weights therein. In a particularly preferred embodiment, the bag is configured to retain the leash and the strap in addition to multiple weights. The bag may further include an internal handle for transporting the multiple weights, the leash and the strap all within the bag. The bag also includes an aerodynamic tear-drop shape that conceals the internal handle and a coupler that engages the leash to the bag during resistance exercise training. An internal adjustable retainer may also be used to secure one or more of the weights inside of the bag to prevent shifting while performing resistance exercise training. The user may further activate a quick-release mechanism coupled to the strap for selectively detaching the leash from the strap on-the-fly, thereby leaving behind the leash, the bag and the one or more weights secured therein. This quick-release mechanism may be particularly preferred during speed burst exercises wherein the user experiences a sudden release of resistance once the bag is detached from the strap.

Furthermore, a resistance exercise training process is used in association with the resistance exercise trainer. Such a process includes the steps of connecting a strap to a first end of the leash, attaching a bag to the second end of the leash, inserting a weight into the bag and then affixing the strap to a user. Then, the user pulls the bag and the weight with the strap through connection with the leash, wherein the weighted bag impedes user movement thereby accomplishing resistance exercise training. As part of the inserting step, a user may secure one or more of the weights inside the bag to prevent shifting during use. In a particularly preferred embodiment, the inserting step includes the step of adding multiple weights to the bag thereby increasing the resistance experienced during the resistance exercise training. The resistance exercise training process may further include the step of releasing the leash from the strap while pulling the weighted bag on-the-fly so the user can work on speed burst training.

The resistance exercise training process further includes the steps of filling or emptying the weight with low-impact material. For example, after filling the weight, the user seals the low-impact material inside of the weight with a water or air tight seal. This ensures that none of the low-impact material escapes the weight during any of the resistance exercise training regimens disclosed herein. Furthermore, such a resistance exercise training process may include the steps of disconnecting the leash from the strap, detaching the leash from the bag and exercising with the leash and the weight individually. In this embodiment, the leash is used for jumping rope and the weight is used for lifting during strength training exercises. In a particularly preferred embodiment, the user may resize the leash for easily jumping rope. Once the user is done using the resistance exercise trainer, the weights, the leash and the strap may be stored inside the bag. A handle inside of the bag may be used to carry the weight, the leash and the strap to a storage location.

Other features and advantages of the present invention will become apparent from the following more detailed description, when taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
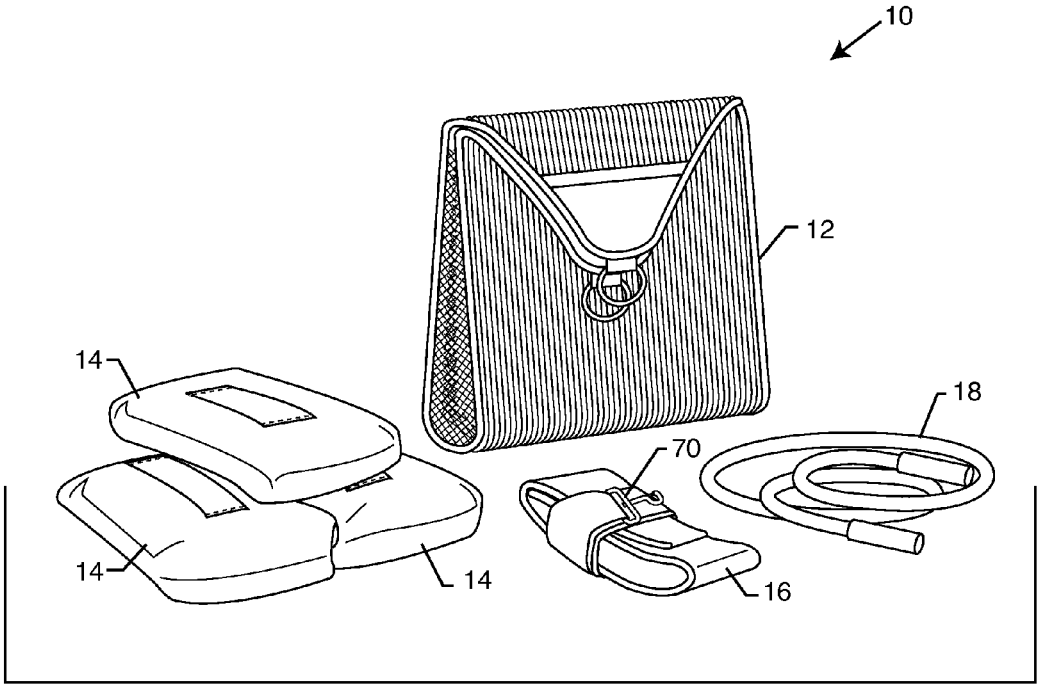
FIG. 1 is a perspective view illustrating a resistance exercise trainer, including a bag, a set of safe weights, a belt and a leash.

As shown in the drawings for purposes of illustration, the present invention for a resistance exercise trainer is referred to generally by the reference number 10. In general, the resistance exercise trainer 10 includes a bag 12, a safe weight 14, a belt 16 and a leash 18. Accordingly, the bag 12, the safe weight 14 (or multiple safe weights 14), the belt 16 and the leash 18 may be sold individually or provided as a kit and sold together as the resistance exercise trainer 10. The resistance exercise trainer 10 is usable by both individuals as well as groups. Exercises associated with the resistance exercise trainer 10 may vary depending on use and the desired workout routine. For example, pulling the bag 12 having the safe weight 14 therein, when coupled to a person 20 via the belt 16 and the leash 18 (FIG. 19), provides efficient, effective and proven resistance training. The resistance exercise trainer 10 and related speed training techniques appeal to both young and old athletes in, for example, primary schools, second schools, high schools, colleges, universities and professional athletics. Use of the resistance exercise trainer 10 allows such athletes to train without the risk of injury and other inconveniences of the aforementioned resistance devices provided in the prior art.

Figure 2:
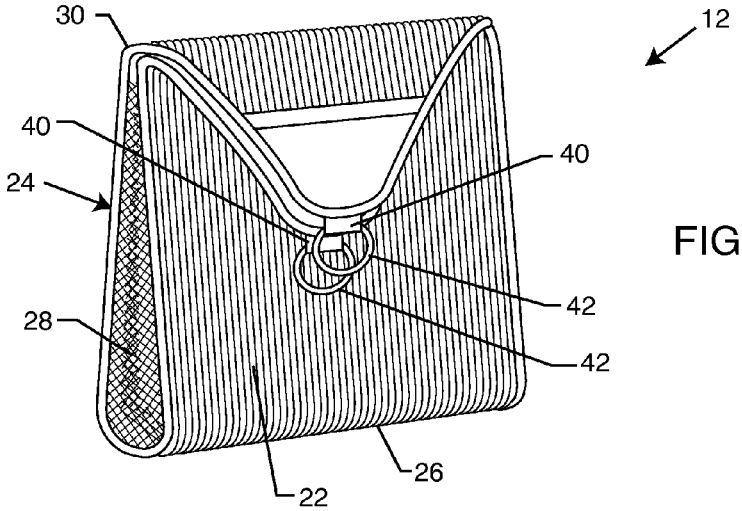
FIG. 2 is a perspective view of the resistance exercise trainer bag.

The bag 12 illustrated in FIG. 2 is constructed of low density materials and is ideal for use with resistance exercises as an alternative to traditional resistance training devices disclosed in the prior art. The bag 12 is also ideal for use in resistance training and speed training programs. The bag 12 is preferably manufactured from any one of a variety of heavy duty materials such as reinforced vinyl, canvas, ballistic materials, rubber, mesh, Kevlar, carbon or other similar materials of comparable strength and durability. The exterior of the bag 12 preferably includes a rigid rubber or vinyl material capable of sliding on grass or synthetic turf while being pulled behind an individual during running or walking. The bag 12 is constructed for optimum durability and is manufactured to be dragged on the ground, a track, a gym floor, on natural grass, on synthetic turf, on ice, through sand, through snow and over most all terrains. The bag 12 may be dragged on a generally planar front surface 22, a generally planar back surface 24 or even a bottom surface 26, as each of the surfaces 22, 24, 26 are made from the same rigid rubber or vinyl material. Moreover, the tear-drop shape of the bag 12, as shown best in FIG. 19, allows the bag 12 to be dragged along either the front surface 22 or the back surface 24, which are symmetrical to one another.

The bag 12 is assembled by connecting a mesh webbing 28 between opposite sides of the front surface 22 and the back surface 24. The mesh webbing 28 preferably comprises an extremely durable material having the capacity to stretch. Such materials may include neoprene, gorilla mesh, netting, rubber, webbing or other similar strong materials. The mesh webbing 28 is able to stretch to accommodate multiple safe weights 14 disposed within the interior of the bag 12. The mesh webbing 28 is not necessarily manufactured out of the materials comprising the front surface 22 and the back surface 24 because the bag 12 is not meant to be dragged along the mesh webbing 28. Accordingly, the mesh webbing 28 attaches to the surfaces 22, 24, 26 along a binding 30 that runs along the exterior of the surfaces 22, 24, 26 as shown in FIG. 2. The binding 30 also comprises a high-strength material resistant to wear during dragging and is therefore extremely durable. The mesh webbing 28 may be attached to the binding 30 by any means known in the art, including stitching.

Figure 3:
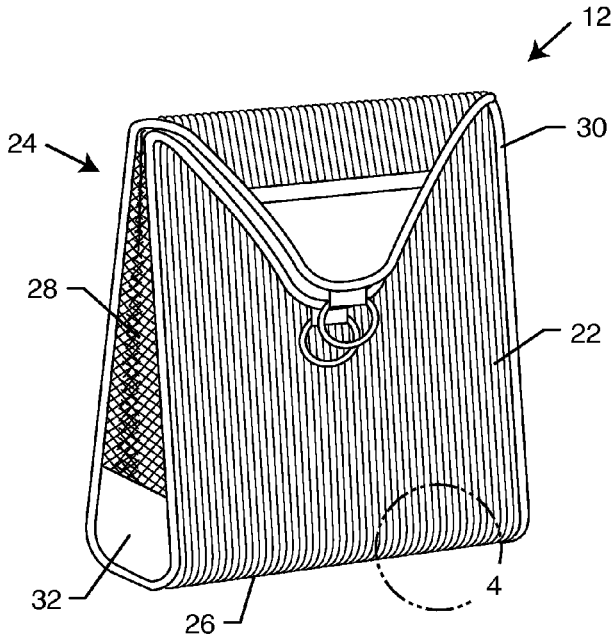
FIG. 3 is a perspective view of the bag including a reinforcement patch.

FIG. 3 illustrates an alternative embodiment of the bag 12 including a reinforcement patch 32 that strengthens the mesh webbing 28. The reinforcement patch 32 preferably comprises a composite material that is substantially resilient to wear and tear. Ideal materials include a fiber-reinforced composite material or another type of woven cloth-fiber filament. The reinforcement patch 32 is located in a corner of the bag 12, as shown in FIG. 3, and may be stitched, double stitched or triple stitched into the front surface 22, the back surface 24, the bottom surface 26, the mesh webbing 28 and/or into the binding 30. The area of the mesh webbing 28 closest to the bottom surface 26 experiences the greatest amount of weight from the safe weights 14 when the bag 12 is dragged during resistance exercise training. The reinforcement patch 32 simply ensures that the stretchable mesh webbing 28 does not rip or otherwise tear away from the surfaces 22, 24, 26 or the binding 30. Moreover, the reinforcement patch 32 may form a pocket with the mesh webbing 28. A logo or other design may be attached to the reinforcement patch 32. This may be particularly desirable for using the bag 12 in association with advertising campaigns.

Figure 4:
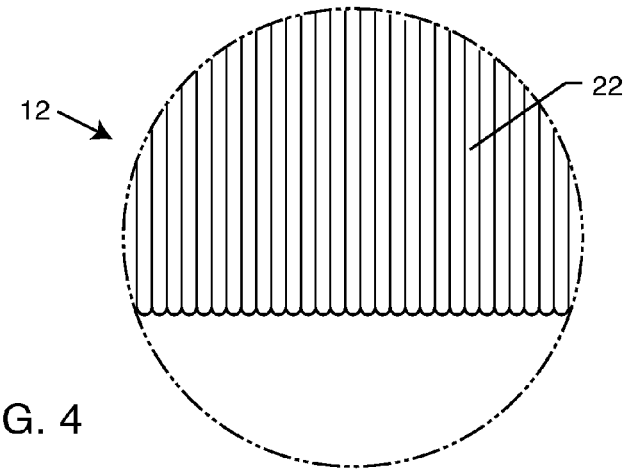
FIG. 4 is an enlarged view taken about the circle 4 in FIG. 3, illustrating the contour of the outer surface of the bag.
Figure 19:
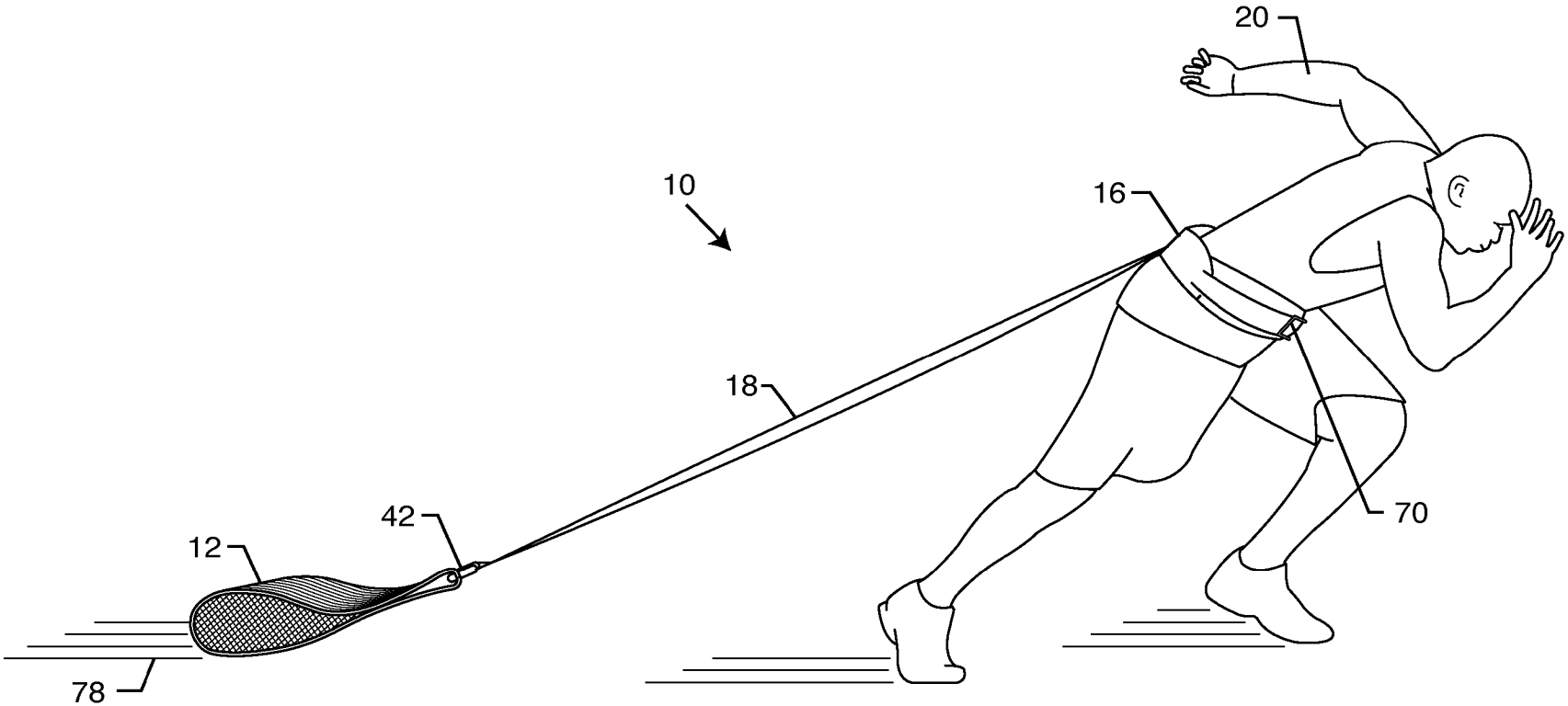
FIG. 19 illustrates an environmental view of the resistance exercise trainer in use.

FIG. 4 is an enlarged view of the front surface 22 of the bag 12. FIG. 4 further illustrates the contoured design of the outer surface 22, which extends around the exterior of the bag 12 to both the back surface 24 and the bottom surface 26. Each of the channels/ridges formed longitudinally along the surfaces 22, 24, 26 ensure that components of the bag 12 do not interfere or obstruct sliding movement thereof during use of the resistance exercise trainer 10 as shown in FIG. 19. The longitudinal nature also ensures that the bag 12 does not become hooked or caught on obstructions on the ground that may have a tendency to jerk the bag 12 to a stop. When this design is combined with the aforementioned rubber and/or vinyl material, the bag 12 easily slides upon any desired surface and the resistance is most closely associated with the quantity of the safe weights 14 within the interior of the bag 12.

Figure 5:
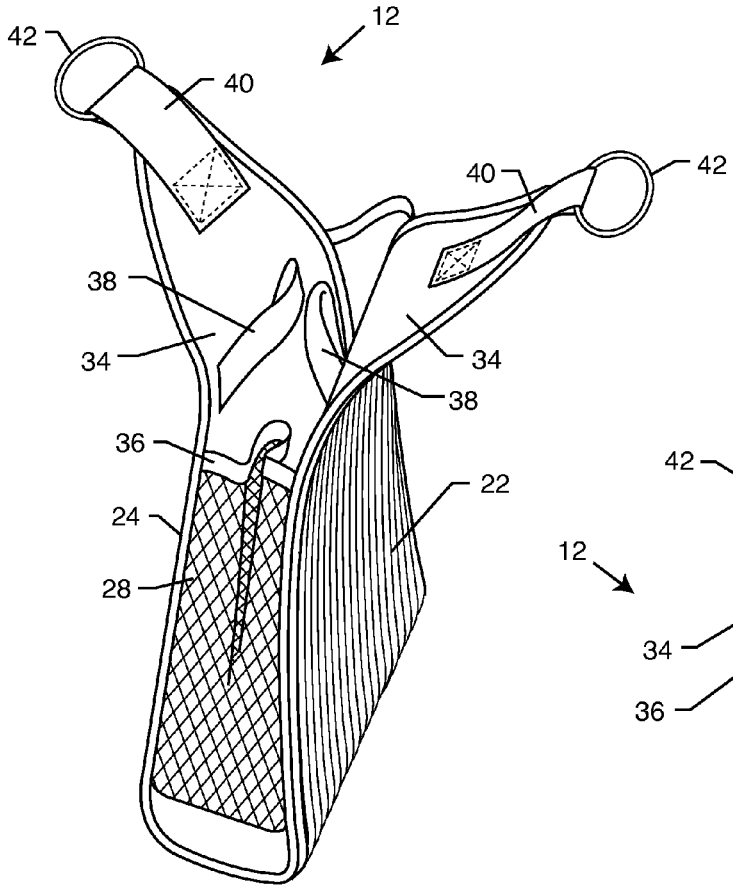
FIG. 5 is a perspective view of the bag and several internal components.

The perspective view in FIG. 5 illustrates opening the bag 12 by separating a pair of tapered sections 34 disposed generally above the mesh webbing 28. The mesh webbing 28 terminates just below the tapered sections 34 that, when separated, provide access to the interior of the bag 12. A portion of the mesh webbing 28 may fold upon itself, as shown, to ensure that the bag 12 remains shut when carrying one or more of the safe weights 14. An elastic band 36 may reinforce the mesh webbing 28 and effectively draw opposite sides of the bag 12 toward one another. Of course, the elastic band 36 stretches so the bag 12 may accommodate numerous items, including multiple safe weights 14. A pair of handles 38 and a pair of extensions 40 looped to retain a pair of O-rings 42 are located along the interior of the bag 12. The handles 38 and the extensions 40 attach to the interior of the bag 12 so none of the components thereof interfere with pulling the bag 12 in accordance with the embodiments disclosed herein. The handles 38 and the extensions 40 are preferably double stitched or triple stitched to the bag 12 to remain securely attached thereto. The stitching should be capable of withstanding at least one hundred pounds of weight resultant from filling the bag 12 with a plurality of the safe weights 14. For example, a user must be able to pick up the bag 12 with the handles 38 to transport the components of the resistance exercise trainer 10, including up to one hundred pounds of the safe weights 14. Moreover, the extensions 40 should also be capable of remaining attached to the bag 12 when a user pulls the bag 12. In this regard, the extensions 40 may experience greater tensional forces than the handles 38 when the user starts pulling the bag 12 from an initial resting position. The extensions 40 may also experience increased tensional forces when the bag 12 encounters additional surface friction or becomes unexpectedly snagged on an object on the ground when being pulled by the user.

Figure 6:
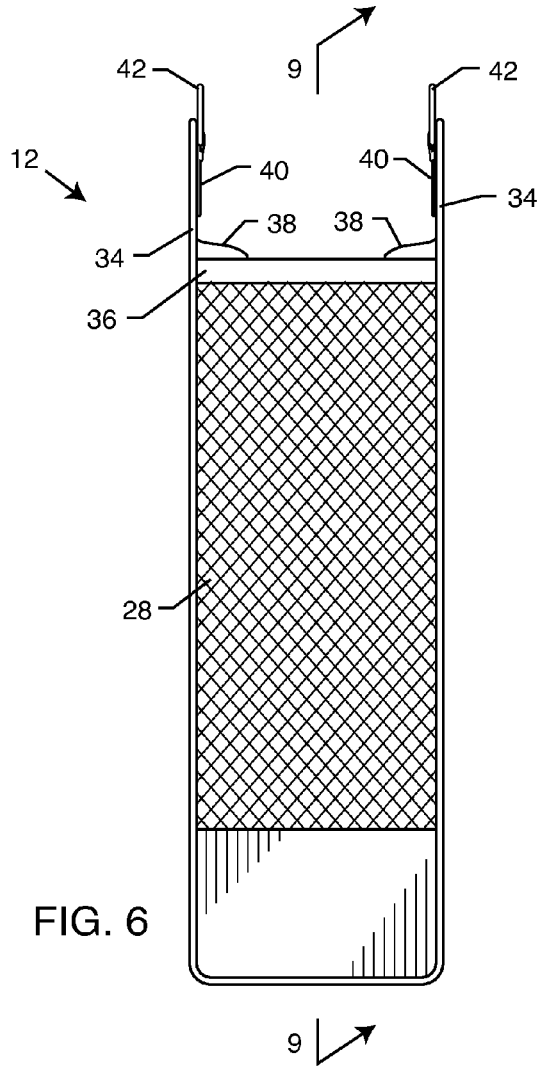
FIG. 6 is a side view of the bag, illustrating the bag in an open position.
Figure 7:
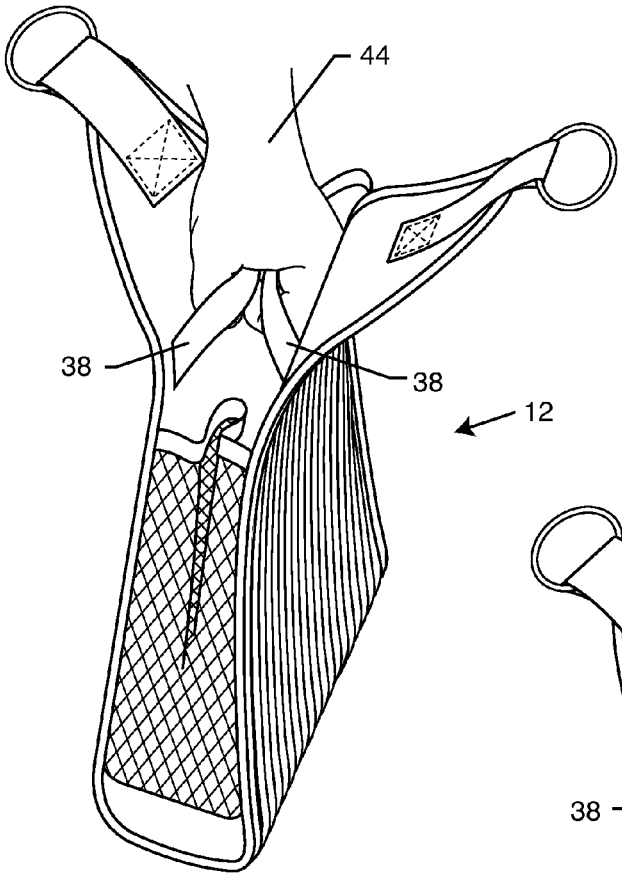
FIG. 7 is a perspective view illustrating grasping the bag by a pair of internal handles.

FIG. 6 is a side view of the bag 12 having each of the tapered sections 34 withdrawn from one another such that a user may access the internal compartment of the bag 12. As shown, the elastic band 36 stretches along with the mesh webbing 28 to allow the user to access the inside of the bag 12. When the bag 12 is open, a user may access the handles 38, in order to transport the bag 12, any safe weights 14 residing therein, the extensions 40 and/or the O-rings 42. The height of the bag 12 is preferably sized to also receive the belt 16 and/or the leash 18 so the bag 12 can transport all of the components of the resistance exercise trainer 10. In this embodiment, the bag 12 stores the safe weights 14, the belt 16 and the leash 18, all which may be transported together through use of the handles 38. FIG. 7 more specifically illustrates a hand 44 grasping each of the handles 38 to transport the bag 12 and any components therein.

Figure 8:
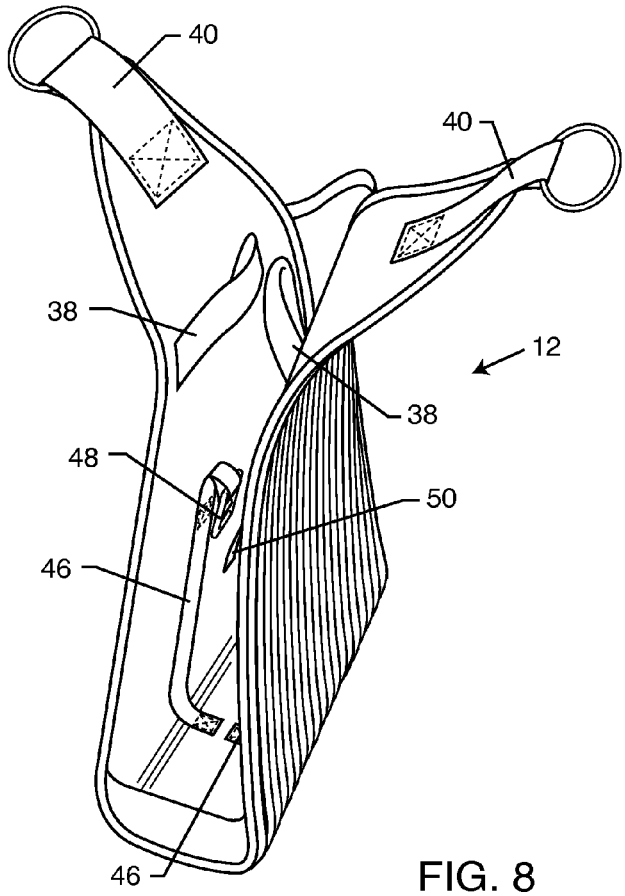
FIG. 8 is a partially cut-away perspective view of the bag illustrating a pair of internal straps for securing the safe weights.
Figure 9:
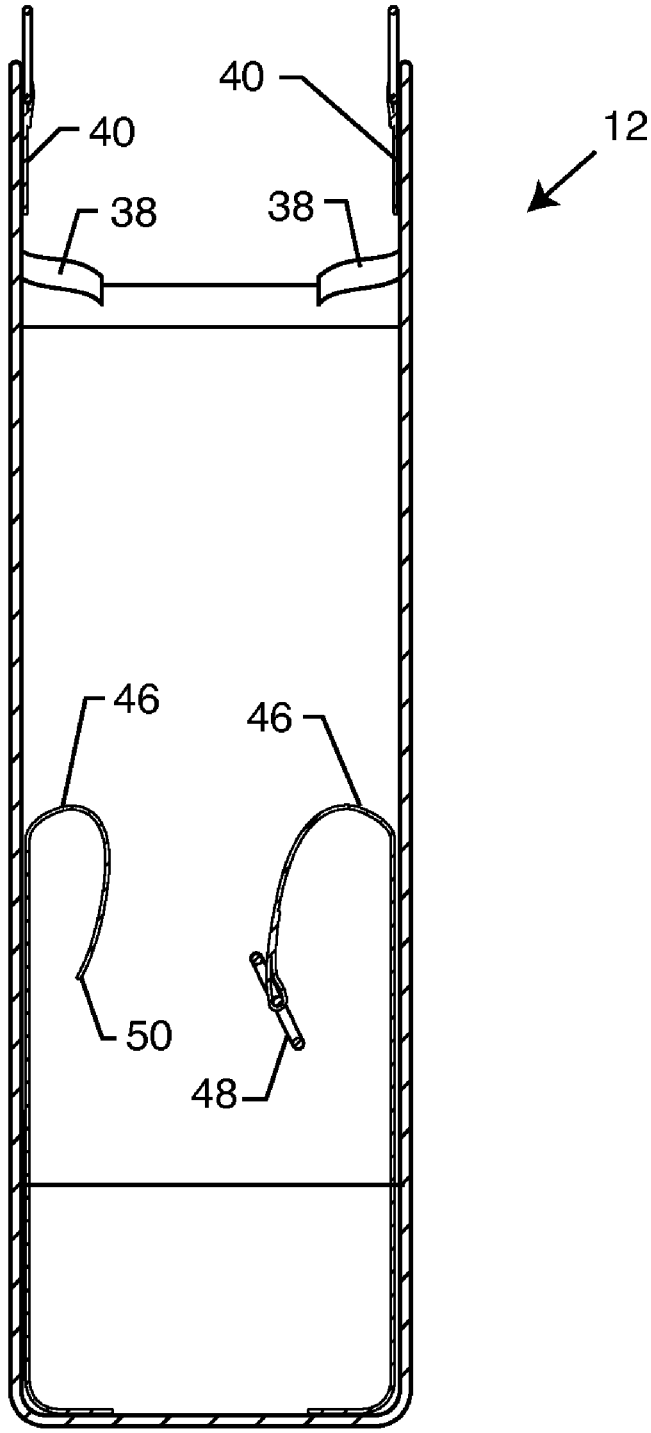
FIG. 9 is a cross-sectional view of the bag taken about the line 9-9 in FIG. 6, further illustrating the internal components of the bag.

FIG. 8 is a partially cut-out perspective view further illustrating the inside of the bag 12. FIG. 9 similarly shows a cross-sectional view of the inside of the bag 12. As shown in both FIGS. 9 and 10, the bag 12 includes a pair of straps 46 at least partially sewn into the interior of the bag 12. The straps 46 are designed to engage one another and to securely retain the safe weights 14. For example, the straps 46 may be stitched or removably attached to one or more sections of the interior of the bag 12. The straps 46 should securely attach to the bag 12 to ensure retainment of the one or more safe weights 14 therein, especially when performing training exercises with the resistance exercise trainer 10. In one embodiment, the straps 46 are double or triple stitched to the interior, in the same or similar manner as are the handles 38 and/or the extensions 40. One of the straps 46 includes a tri-glide 48 looped or otherwise threaded into the corresponding strap 46. The other strap 46 has an engagement end 50 that threadingly secures to the tri-glide 48. A person of ordinary skill in the art will readily recognize that each of the straps 46 may selectively engage one another by one or more mechanisms known in the art. In one example, the tri-glide 48 and the engagement end 50 are replaced by complementary strips that include hook and loop fasteners, buttons, snaps, etc. In a preferred embodiment, the straps 46, which may include the tri-glide 48 and the engagement end 50, are preferably adjustable such that a user may tighten or loosen the straps 46 depending on the quantity of the safe weights 14 in the interior of the bag 12. The tri-glide 48 is particularly useful in this embodiment because the user may thread more or less material of the strap 46 having the engagement end 50 through the tri-glide 48 to lengthen or shorten the encompassing nature of the straps 46 around the safe weights 14.

Figure 10:
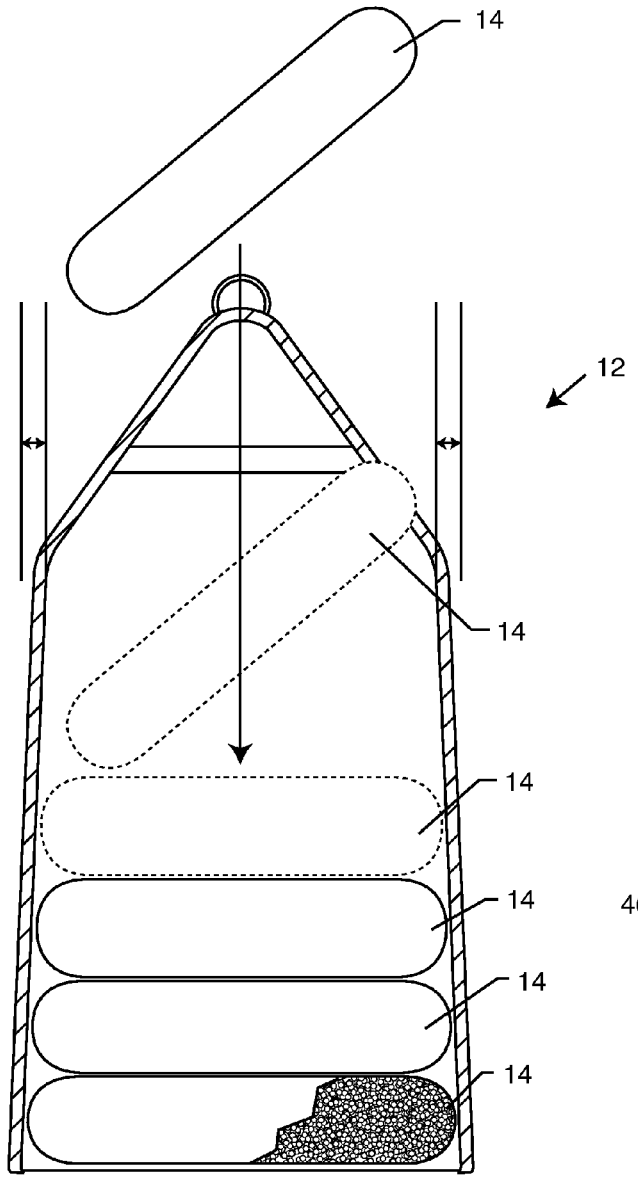
FIG. 10 is a schematic view illustrating insertion of a plurality of safe weights into the bag.
Figure 11:
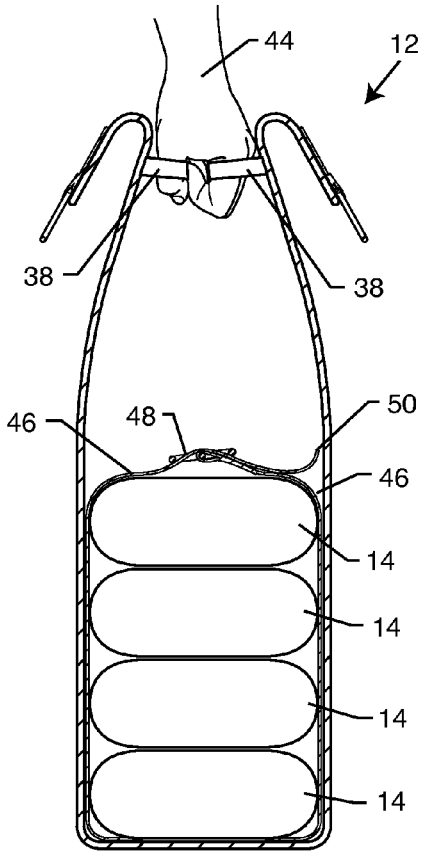
FIG. 11 is another schematic view illustrating picking up a plurality of the safe weights in the bag with the handles.

FIGS. 10 and 11 are cross-sectional views of the bag 12 illustrating placement (FIG. 10) and retention (FIG. 11) of a plurality of the safe weights 14 within the interior of the bag 12. As briefly described above, the mesh webbing 28 is capable of stretching to accommodate one or more of the safe weights 14 placed within the bag 12. The bag 12 is designed to hold at least one safe weight 14 and is preferably sized to hold up to ten of the safe weights 14. FIGS. 10 and 11 are not drawn to scale in this regard. A person of ordinary skill in the art will readily recognize that the size of the bag 12 may be bigger or smaller depending on the size and/or desired quantity of the safe weights 14 to be held in the bag 12 for purposes of using the resistance exercise trainer 10. In a particularly preferred embodiment, each of the safe weights 14 weigh ten pounds. A user may therefore add weight to the bag 12 in increments of ten pounds (e.g. 10, 20, 30, 40, 50 or 60 pounds, etc.). Accordingly, the bag 12 should easily accommodate up to, but not limited by, at least ten of the ten pound safe weights 14, thereby aggregating to one hundred pounds of weight when the bag 12 is full. Hence, the material comprising the front surface 22 and the back surface 24 must be able to withstand being dragged across grass, synthetic turf or other terrains and/or surfaces having at least one hundred pounds of weight placed therein. An individual may drag the bag 12, as described below, while walking, running, skating or during any other training regimen designed to increase speed, strength or agility. Pulling the bag 12 is one aspect of the resistance exercise trainer 10 that teaches resistance training to build endurance and speed. The bag 12 may be manufactured in various sizes such that additional safe weights 14 may be placed therein to increase the overall weight to well over one hundred pounds (e.g. two hundred pounds).

More specifically with respect to FIG. 10, each safe weight 14 is inserted into the interior of the bag 12 diagonally as generally shown in phantom. At least partial diagonal insertion of the safe weight 14 is required as a result of the stretchable mesh webbing 28 and the elastic band 36 that generally endeavors to close the sides of the bag 12. Of course, the mesh webbing 28 and the elastic band 36 easily stretch to accommodate insertion of the safe weight 14 for snug retention therein. Each of the safe weights 14 comfortably reside within the interior of the bag 12 as shown in FIG. 11. After the user inserts the desired quantity of the safe weights 14 (e.g. four safe weights 14 in FIG. 11), each of the safe weights 14 are secured through use of the aforementioned straps 46. For example, the engagement end 50 of one of the straps 46 is threaded through the tri-glide 48 of the opposite strap 46. The straps 46 are tightened to the uppermost of the safe weights 14 by pulling the engagement end 50 taut through the tri-glide 48. The additional material of the strap 46 extending from the tri-glide 48 to the engagement end 50 may be threaded back through the tri-glide 48 and used to retain additional safe weights 14. For example, a user may endeavor to insert a fifth safe weight 14 into the interior of the bag 12 such that the strap 46 having the engagement end 50 needs loosening to accommodate the additional width of the fifth safe weight 14. FIG. 11 also illustrates that the hand 44 may comfortably extend into the interior of the bag 12 to engage each of the handles 38. This enables the user to carry the bag 12 or perform exercises with the bag 12 in accordance with the resistance exercise trainer 10. Moreover, the gap between the fourth safe weight 14 and the handles 38 may be used to house the belt 16 and/or the leash 18 if the user endeavors to transport the resistance exercise trainer 10 from one location to another. This feature is also particularly desirable to keep each of the components of the resistance exercise trainer 10 together during non-use.

Figure 12:
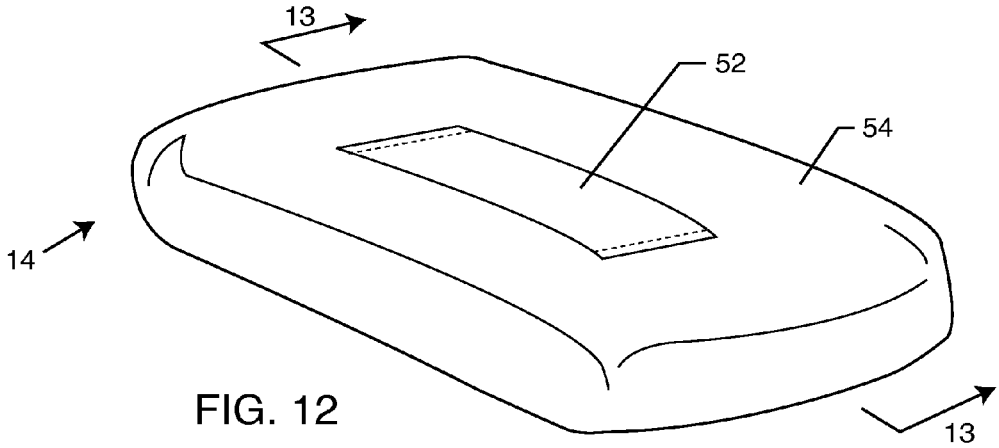
FIG. 12 is a perspective view of the safe weight.
Figure 13:
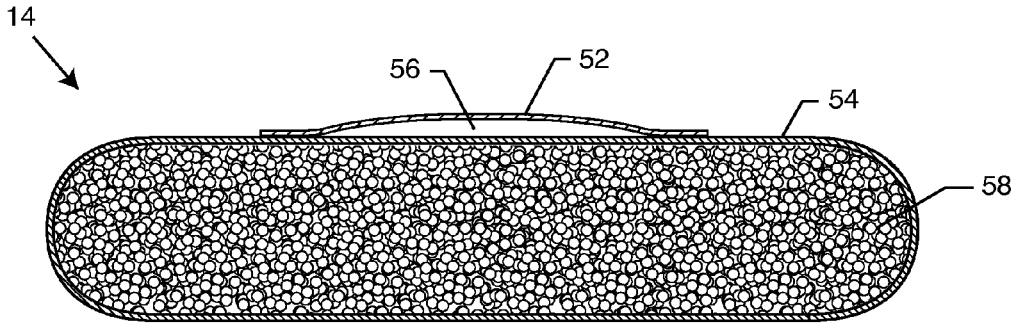
FIG. 13 is a cross-sectional view of the safe weight taken about the line 13-13 in FIG. 12, illustrating a plurality of granules within the safe weight.
Figure 21:
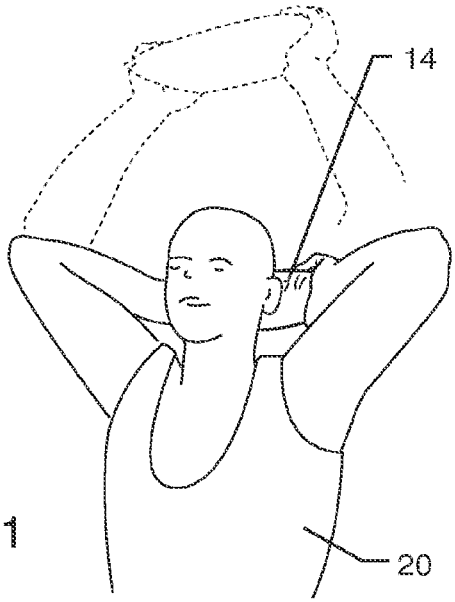
FIG. 21 is an environmental view illustrating an exercise using the safe weight.
Figure 23:
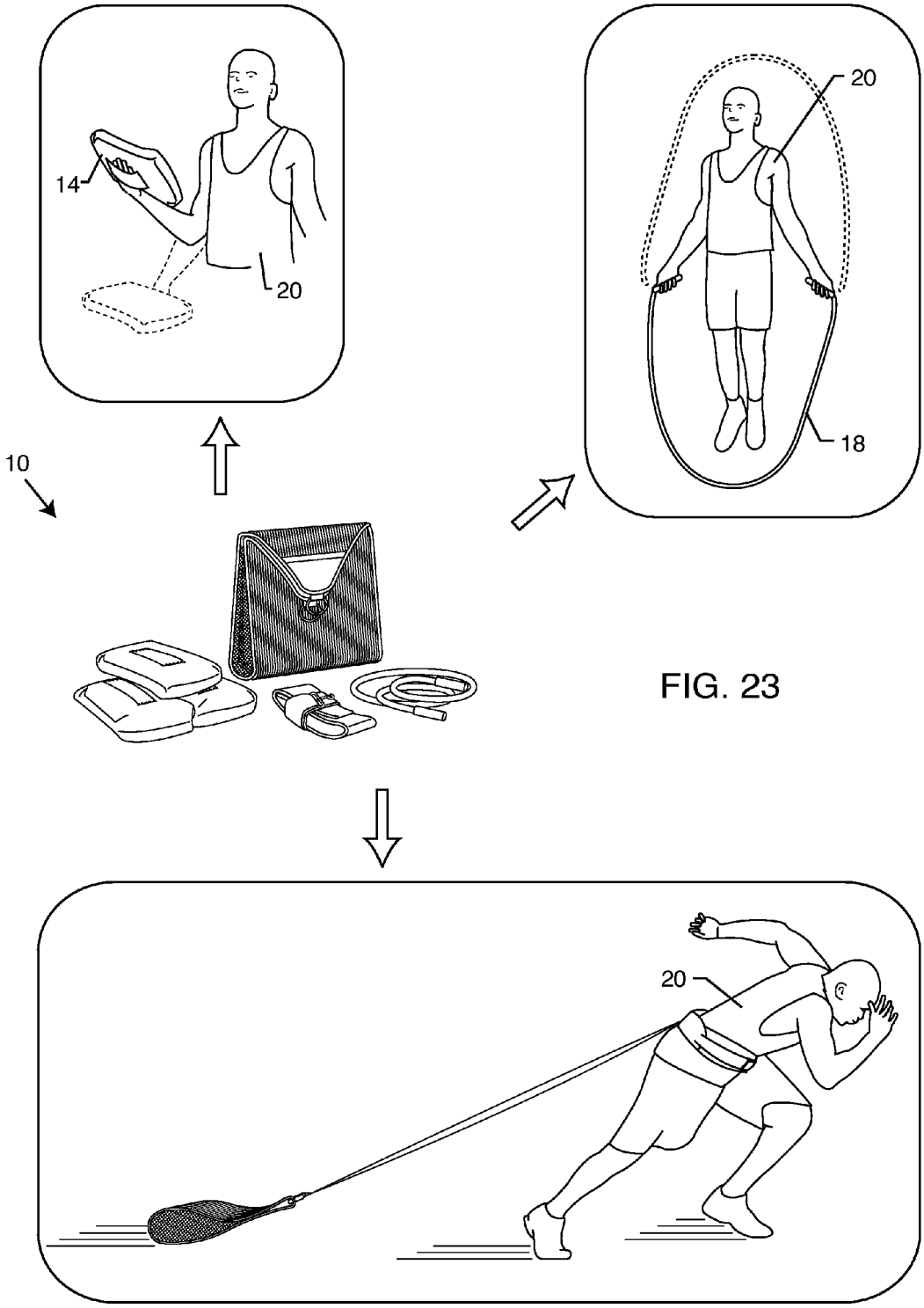
FIG. 23 is a schematic illustrating a speed training regimen using the resistance exercise trainer.

FIG. 12 illustrates the safe weight 14 removed from the bag 12. The safe weights 14 are low impact weights primarily designed to be loaded and hauled in the bag 12 for resistance training purposes. The safe weight 14 may also be grabbed by the person 20 in the manner shown in FIGS. 21 and 23. The safe weight 14 preferably includes a handgrip 52 to enable the person 20 to grasp the safe weight 14 in the manner shown in FIG. 23. The handgrip 52 increases the versatility of the safe weight 14 and the quantity of exercises that may be performed by the person 20. This enables the person 20 to use the safe weight 14 to work various muscles in the body during weight training. The person 20 in FIG. 21 is performing triceps exercises while the person 20 in FIG. 23 is performing biceps exercises. FIG. 13 illustrates a cross-sectional view of the safe weight 14 and the positioning of the handgrip 52 relative to a top surface 54 thereof. The handgrip 52 is stitched to the top surface 54 by any of the aforementioned stitching means. Preferably, a gap 56 is created between the top surface 54 and the handgrip 52 that enables the person 20 to slide the hand 44 therebetween (e.g. FIG. 23). Accordingly, the hand 44 of the person 20 should snugly fit into the gap 56 such that the safe weight 14 may be held securely and symmetrically. The hand 44 may clench somewhat to grasp the safe weight 14. The pressure applied to a plurality of dry granules 58 (or pellets) therein enables the person 20 to slightly reposition the fingers to permit a solid, molded fit to the palm of the hand of the person 20. The safe weights 14 could also be filled with other low or no-impact material such as water or gel.

In one embodiment, the safe weights 14 are pre-bagged with ten pounds of the dry granules 58 packaged in thick heat-sealed poly-bags designed to prevent accidental spillage of the contents therein. The dry granules 58 may also comprise pellets or other low-density beads known in the art. The filled poly-bag weights are then inserted into a strong material bag manufactured from reinforced vinyl, canvas, ballistic material, etc. The handgrip 52 is stitched to the top surface 54 of the material bag to allow convenient handling or gripping while performing an exercise regimen, as described above. The poly-bag may also be filled with any quantity of the granules 58 to vary the weight of the safe weight 14. Accordingly, the resistance exercise trainer 10 may be sold in a kit that has a plurality of the safe weights 14 that are the same weight (e.g. 10 lbs.) or include various weights. For example, the safe weights 14 may be specifically manufactured to retain two, five, ten or twenty pounds of the granules 58. The choice of using the dry granules 58 as opposed to sand is to lessen the density of the load in the safe weight 14. Sand can retain moisture and thereafter "cake", which makes the sand denser and adds water weight. The dry granules 58 refrain from caking, clumping and/or retaining additional moisture. Thus, if the safe weight 14 is accidentally dropped, e.g. on a foot, the dry granules 58 are capable of dispersing at the point of impact (lowering the density thereof) thereby substantially reducing the risk of injury due to such accidents.

Figure 14:
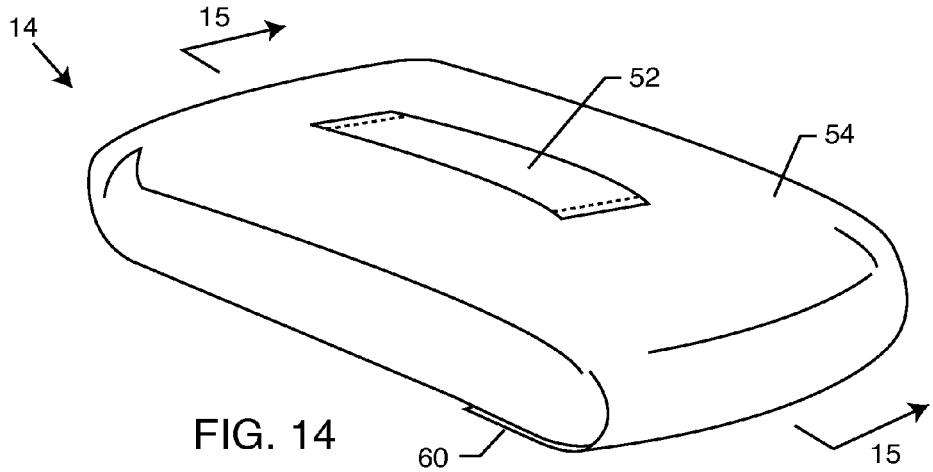
FIG. 14 is a perspective view of a refillable safe weight.
Figure 15:
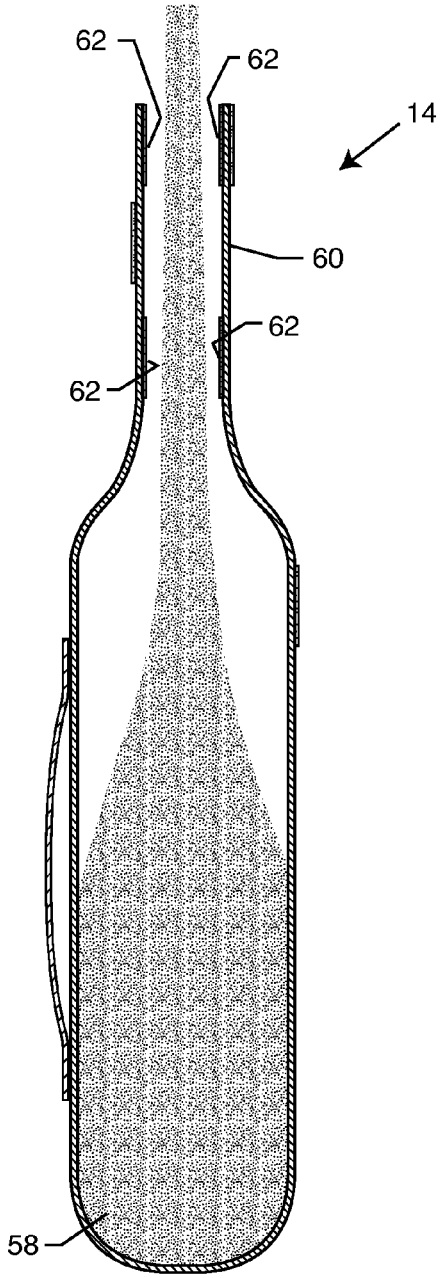
FIG. 15 is a cross-sectional view taken about the line 15-15 in FIG. 14, illustrating filling the safe weight through a sleeve.
Figure 16:
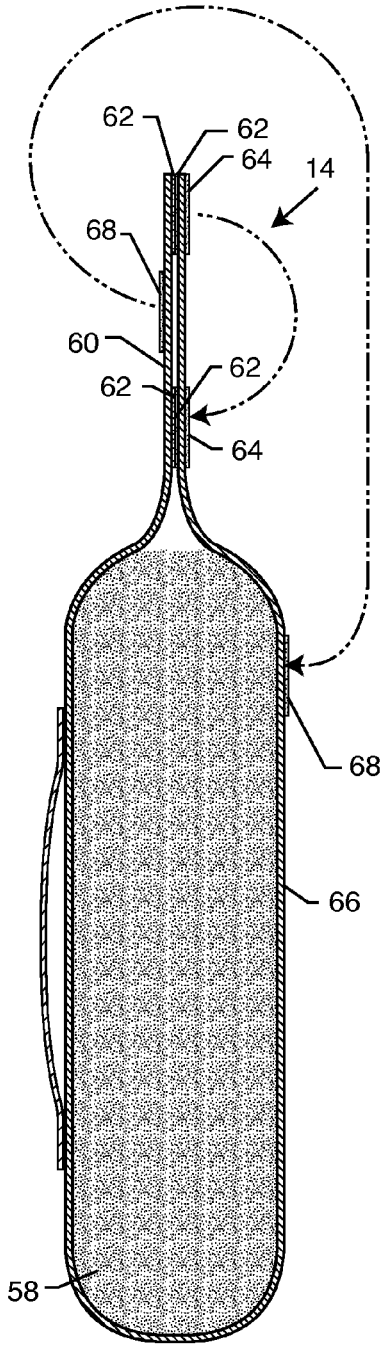
FIG. 16 is an alternative cross-sectional view of FIG. 15, illustrating attachment of a pair of internal zippers.
Figure 17:
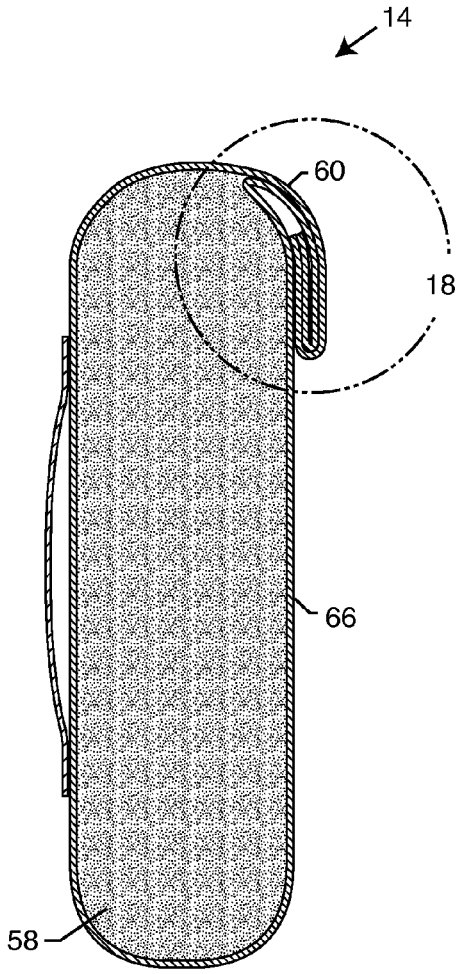
FIG. 17 is another cross-sectional view of the safe weight of FIG. 15, illustrating the sleeve triple sealed to the encasement of the safe weight.
Figure 18:
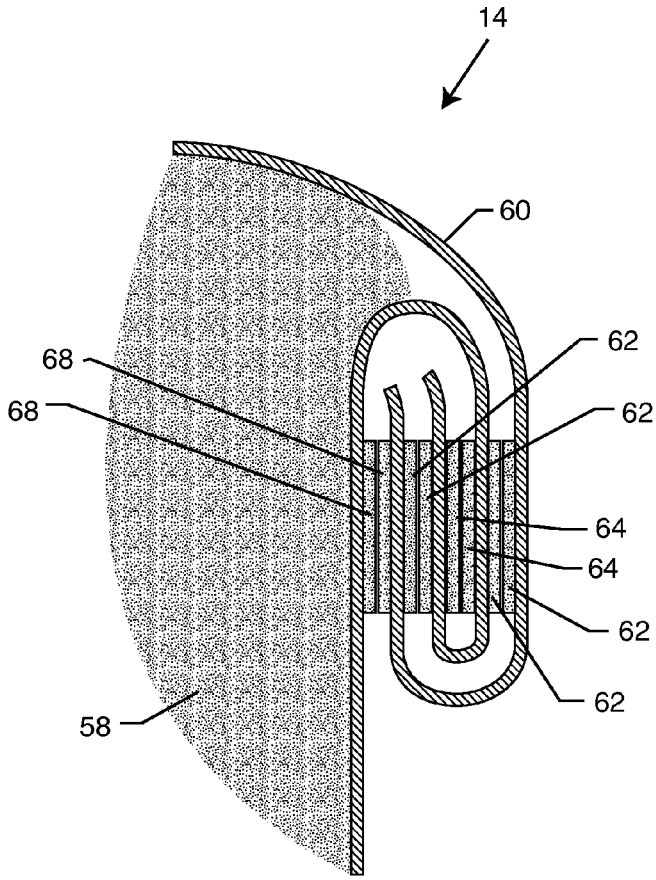
FIG. 18 is an enlarged view taken about the circle 18 in FIG. 17, illustrating the sleeve triple sealed to the encasement of the safe weight.

FIG. 14 illustrates an alternative embodiment of the safe weight 14 having the handgrip 52 stitched to the top surface 54 thereof. In this embodiment, the safe weight 14 includes a selectively sealable sleeve 60 that enables a user to fill or empty the granules 58 into or out from the interior of the safe weight 14. The process for filling and sealing the safe weight 14 is generally shown in FIGS. 15-18. A person of ordinary skill in the art will readily recognize that the safe weight 14 may be emptied through a reverse procedure with respect to the embodiments described in FIGS. 15-18. FIG. 15 illustrates an embodiment wherein the sleeve 60 is open and receiving the granules 58 therethrough. Once the safe weight 14 is filled with the granules 58 to approximately the sleeve 60, each side of the sleeve 60 is moved inwardly so a pair of the internal sealers 62 can engage one another to seal off the interior of the safe weight 14 in the manner shown in FIG. 16. The internal sealers 62 may include any mechanism known in the art for attaching one side of the sleeve 60 to the other, such as zippers. Preferably, the internal sealers 62 provide a water and air tight seal to prevent any of the granules 58 from escaping from within the interior of the safe weight 14. When the safe weight 14 is filled with sand, it is important that the internal sealers 62 lock out water or moisture to ensure that the sand does not "cake" or otherwise retain water weight. It is especially important that the internal sealers 62 are water tight when the safe weight 14 is filled with water. Two sets of the internal sealers 62 are shown with respect to FIGS. 15-18, but a person of ordinary skill in the art will readily recognize that multiple sets of internal sealers 62 may be used with the safe weight 14 depending on the desired application. For example, additional internal sealers 62 may be needed in the event that the safe weight 14 can retain more than ten pounds of weight, and less internal sealers 62 may be required if the safe weight 14 holds less than ten pounds of weight.

The sleeve 60 also includes a pair of external sealers 64. The sleeve 60 is long enough such that it may fold upon itself wherein one external sealer 64 may engage the other external sealer 64, as shown along the directional arrow in FIG. 16. This feature further ensures that the contents of the safe weight 14 remain securely retained therein. By bending the sleeve 60 to engage the external sealers 64, the granules 58, in the preferred embodiment, are essentially choked off from disengaging both of the internal sealers 62. This is particularly preferred as the size and weight of the safe weight 14 may cause significant pressure and stress along the surface where the internal sealers 62 are located to connect opposite sides of the sleeve 60. The external sealers 64 may comprise a set of complementary hook and loop fasteners, buttons, snaps or other clips for retaining a portion of the sleeve 60 to itself at an approximate ninety degree angle. The seal formed by the external sealers 64 does not necessarily need to be water or air tight as this desirable characteristic is already being performed by the internal sealers 62. Without the external sealers 64, disconnection of the internal sealers 62 may otherwise cause immediate loss of the contents of the safe weight 14. This is particularly undesirable when the safe weight 14 is retaining the dry granules 58. Moreover, the sleeve 60 may fold over and attach to a bottom surface 66 of the safe weight 14 as shown generally in FIG. 17 and more specifically shown in FIG. 18. In this regard, the sleeve 60 is configured to double and triple seal the granules 58 within the enclosure of the safe weight 14. To accomplish this, the sleeve 60 further includes a body sealer 68 that folds over and engages a similar body sealer 68 attached to the bottom surface 66 of the safe weight 14. The body sealers 68 retain the sleeve 60 along the exterior of the safe weight 14. This ensures that the fillable safe weight 14 shown in FIGS. 15-18 retains a substantially contoured shape (best shown in FIG. 17) similar to that of the safe weight 14 illustrated in FIGS. 12-13. The triple seal of the sleeve 60 is best shown in the enlarged view of FIG. 18. The body sealers 68 may further be used to prevent any of the contents, e.g. the granules 58, from escaping out from within the interior of the safe weight 14. The body sealers 68 do not necessarily form a water tight or air tight seal, but may include any of the sealing mechanisms described above with respect to the internal sealers 62 or the external sealers 64.

FIG. 19 illustrates the bag 12 connected to the person 20 via the leash 18 and the belt 16. The leash 18 is preferably manufactured from a webbing material (e.g. poly-webbing), stretchable materials, cable, nylon, elastic, heavy duty strap, bungee, rope (e.g. woven rope), plastic coated cable or other similar materials capable of removably connecting the leash 18 to both the belt 16 and the bag 12. At one end, the leash 18 may connect to the bag 12 with a snap hook, O-ring, carabiner, or other various clips capable of connecting into grommets, O-rings or D-rings. For example, FIG. 2 illustrates the bag 12 having the O-rings 42 mounted to corresponding ends of the extensions 40. The O-rings 42 are preferably the only part of the bag 12 that is somewhat externally accessible during use. The leash 18 may be connected to the bag 12 through grommets set into the bag 12 in hard tooling leather that includes, but is not limited to, vegetable tan leather. Alternatively, the leash 18 could also be connected to the bag 12 by running the leash 18 through an oblong grommet or through the O-rings 42. A person of ordinary skill in the art will readily recognize that there are many ways to removably yet securely attach the leash 18 to the bag 12 so the person 20 may pull the bag 12 in accordance with FIG. 19.

On the other end, the leash 18 connects to the belt 16 through O-rings, D-rings, tri-clips, tri-glides or heavy duty Velcro triple sewn onto the belt 16. For example, the leash 18 may fold over and attach to a tri-glide for the purpose of keeping excess leash material or slack from interfering with the person 20 during use. The tri-glide also allows the person 20 to adjust the length of the leash 18 depending on the size of the person 20. In this regard, taller persons would preferably lengthen the leash 18 and shorter persons may endeavor to shorten the length of the leash 18. Moreover, other small hardware may also removably connect the leash 18 to the belt 16. Less preferably, the leash 18 may be permanently stitched to the belt 16.

Figure 20:
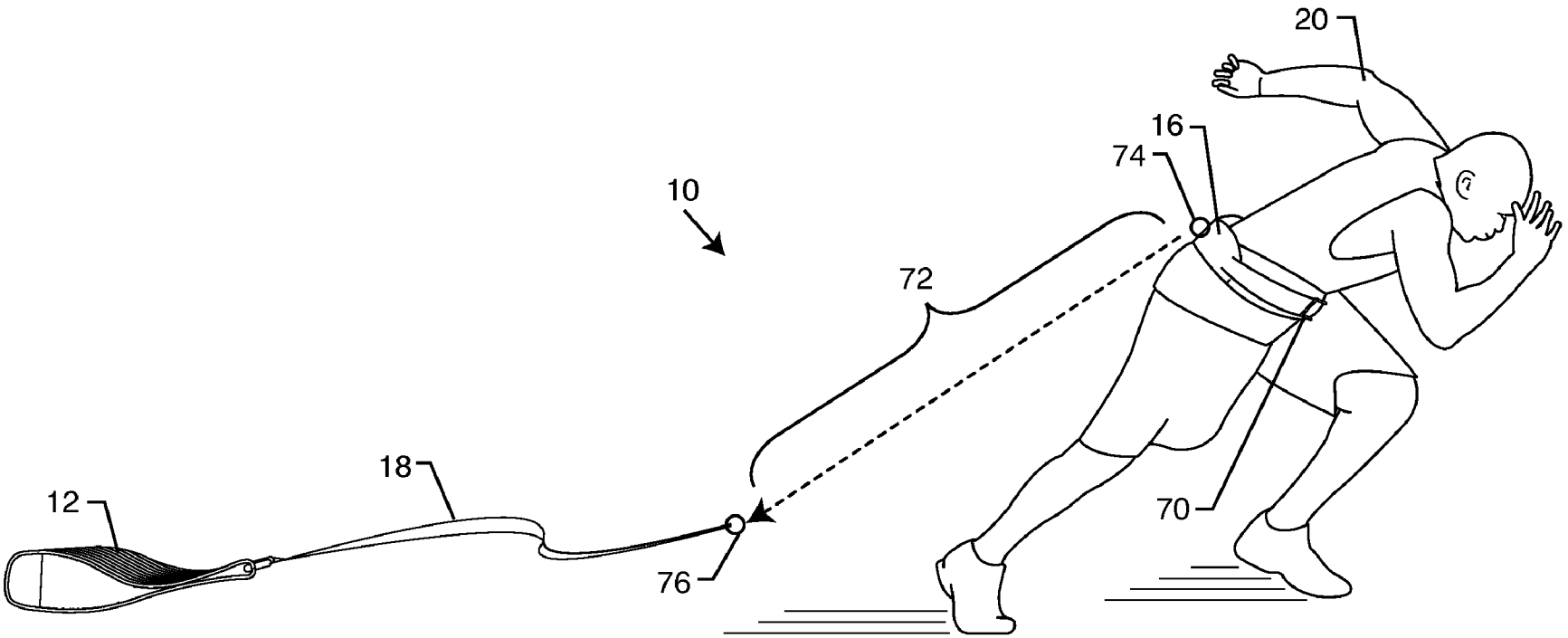
FIG. 20 is an environmental view illustrating disconnection of the leash from the belt on-the-fly via a quick release mechanism.

In another alternative embodiment, the leash 18 may removably attach to the belt 16 via a release mechanism 72. FIG. 20 illustrates the person 20 accessing the release mechanism 72 integrated into the back portion of the belt 16. The release mechanism 72 generally includes a disengagement member 74 that selectively attaches to an engagement member 76 integrated into one end of the leash 18. Accordingly, the engagement member 76 may selectively disengage the disengagement member 74 on-the-fly during use of the resistance exercise trainer 10. For example, the person 20 starts by dragging the bag 12 as shown in FIG. 19. At some point, the person 20 selectively accesses the release mechanism 72, and specifically the disengagement member 74, to disconnect the leash 18 and the bag 12 from the belt 16. The release mechanism 72 may comprise a snap, hook, lever, U-lock or another mechanical or adhesive mechanism that enables the person 20 to easily disconnect the disengagement member 74 from the engagement member 76 on-the-fly. The release mechanism 72 may also be integrated into the belt 16 such that the person 20 may hold or access a portion of the release mechanism 72 in a more convenient location than the lower back area of the person 20. In this embodiment, the person 20 may pull a lever or string-type mechanism integrated into the front side of the belt 16 that causes the disengagement member 74 to release the engagement member 76. The release mechanism 72 may be particularly desirable for speed burst training and other agility, speed or dexterity training.

The belt 16 is best illustrated in FIG. 1 and is preferably made from a strong webbing material capable of withstanding high resistances due to weights in the bag 12 and motion by the person 20 (FIGS. 19 and 20). The belt 16 is preferably easily adjustable among a wide range of sizes and may easily strap to a number of individuals having various waist sizes. The belt 16 adjusts by folding one end of the belt 16 over and through a buckle 70 (FIGS. 19 and 20). Excess portions of the belt 16 may attach to itself with a complementary strip of hooks and loops, such as Velcro. The buckle 70 may be manufactured from a rigid material such as metal or plastic to ensure durability. The belt 16 could also comprise one of multiple harnesses capable of connecting the leash 18 at the back of the belt 16. Such a harness may attach around the shoulders (e.g. a shoulder strap), upper torso or another portion of the upper body of the person 20. This allows the person 20 to use the resistance exercise trainer 10 while walking, running, climbing, swimming, skating or while performing other speed and endurance training exercises or regimens. Moreover, the belt 16 should be manufactured from a material and have a width capable of withstanding curling around the torso of the person 20 while pulling the bag 12 and the corresponding safe weights 14. Any one of these different embodiments are suitable to perform the related speed training exercises associated with the resistance exercise trainer 10.

FIG. 19 illustrates one preferred use of the resistance exercise trainer 10. As shown, the person 20 is dragging the bag 12 along a surface 78. The person 20 is wearing the belt 16 and is coupled to the bag 12 via the leash 18, as described above. The person 20 experiences resistance from the bag 12 when running. The weight of the bag 12, which includes the safe weights 14, drags along the surface 78 and exerts a resistive force as the person 20 endeavors to move the bag 12 in the direction shown generally in FIG. 19. The resistance exercise trainer 10 enables the person 20 or multiple individuals or teams, to simultaneously drag the bag 12 containing one or more safe weights 14 for safe and effective resistance in speed training. If the person 20 falls while running or is accidentally hit by another bag 12 having one or more safe weights 14 therein, the impact or collision therebetween is harmless. Colliding with or otherwise impacting a traditional metal sled can be extremely harmful and can cause injury to one or more persons. This is particularly detrimental for individuals or a player on a team. Another important aspect of the resistance exercise trainer 10 is that the bag 12 immediately ceases moving after the person 20 stops pulling the bag 12. The bag 12 stops because either the front surface 22 or the back surface 24 is fully engaged against the ground surface 78. The friction between the front surface 22 or the back surface 24 and the ground surface 78, in conjunction with the granulars 58 in the safe weight 14, causes the momentum of the bag 12 to immediately stop when the person 20 stops exerting a force thereon. Momentum associated with traditional sleds or skids allows the devices to continue moving, even after sudden stops, as the entire weight of the sled typically rests on two metal bars. Hence, the overall construction and fabrication of the components making up the resistance exercise trainer 10 are particularly safer in view of the prior art and do not comprise high density materials such as metals, woods, hard plastics, fiberglass, etc. that can injure an athlete.

Figure 22:
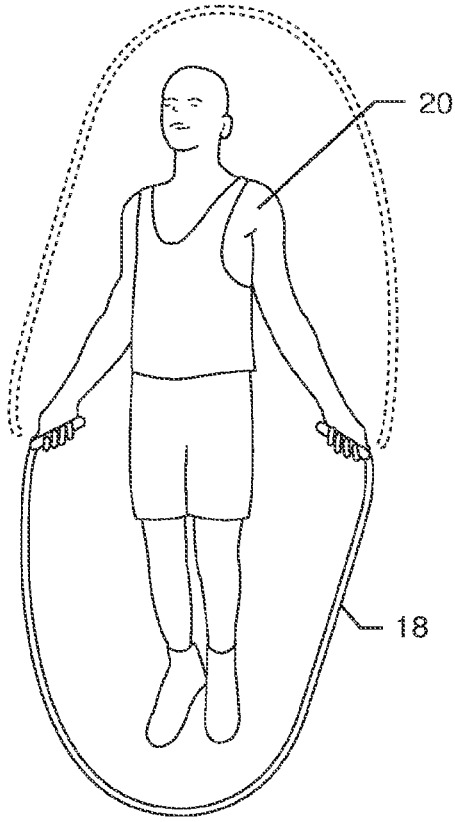
FIG. 22 is an environmental view illustrating use of the leash as a jump rope.

The leash 18 is also extremely versatile and has multiple uses in association with the resistance exercise trainer 10. FIG. 1 illustrates the leash 18 disconnected from the bag 12 and the belt 16 and substantially coiled. The versatility of the leash 18 allows it to be folded upon itself for easy and compact storage. The compact nature of the leash 18 also enables a user to store or transport the leash 18 in the interior of the bag 12, as described above. FIG. 22 illustrates a particularly preferred use for the leash 18 in accordance with the corresponding speed training process of the resistance exercise trainer 10. Here, the leash 18 is used as a jump rope. The person 20 may use the leash 18 as a jump rope as a solitary exercise or in conjunction with an exercise regimen as described below with respect to the speed training triangle. The length of the leash 18 should also be adjustable to better accommodate the height of the person using the leash 18 as a jump rope.

FIG. 23 illustrates using the resistance exercise trainer 10 in three separate stages called the speed training triangle. In one aspect, the person 20 may use the safe weight 14 in weight lifting exercises. As shown in FIG. 23, the person 20 uses the safe weight 14 as a hand-held weight. Here, the person 20 exercises arm muscles by performing curls, shoulder presses, tricep extensions or bench presses that work the pectorals and other arm muscles. The construction of the safe weight 14 as described above eliminates the risk of harm due to accidental impact of the safe weight 14 on the body of the person 20. In another aspect of the speed training triangle, the person 20 uses the leash 18 as a jump rope, as described above with respect to FIG. 21. Jumping rope is particularly desirable for increasing endurance. Lastly, the person 20 may use the resistance exercise trainer 10 in resistance training exercises as described and shown in FIGS. 19 and 20 above. The speed training triangle was developed to complement the bag 12 and the safe weights 14 such that the person 20 has the ability to train and concentrate on increased speed and endurance with one resistance exercise trainer 10. Moreover, the resistance exercise trainer 10 is particularly suited for individuals as the bag 12, the safe weight 14, the belt 16 and the leash 18 are compact and easily storable. For instance, twenty-four of the safe weights 14 take up the space of a traditional metal sled.

Although several embodiments have been described in detail for purposes of illustration, various modifications may be made to each without departing from the scope and spirit of the invention. Accordingly, the invention is not to be limited, except as by the appended claims.

What is claimed is:

1. A resistance exercise trainer, comprising:

a flexible belt wearable by a user;

a leash having a first end attached to the belt, and a second end; and a slidable bag attached to a second end of the leash, the slidable bag having a generally planar front surface and generally planar back surface, each having an exterior surface forming longitudinally extending channels/ridges, and mesh webbing between opposite sides of the front surface and the back surface, the slidable bag being configured for removable reception of at least one weight.

2. The trainer of claim 1, wherein the front surface of the bag is folded over the back surface to define an interior of the bag in which the at least one weight may be disposed.

3. The trainer of claim 2, wherein the mesh webbing accommodates multiple weights disposed within the interior of the bag.

4. The trainer of claim 2, including at least one reinforcement patch attached to the bag for strengthening the mesh webbing.

5. The trainer of claim 1, wherein the front surface and the back surface each include a tapered section disposed generally above the mesh webbing.

6. The trainer of claim 1, including a quick-release mechanism coupled to the belt for selectively detaching the leash from the belt on-the-fly by the user as the bag is being pulled by the user during resistance exercise training.

7. The trainer of claim 1, wherein the bag includes an adjustable internal retainer for securing the at least one weight inside the bag.

8. The trainer of claim 1, wherein the leash is configured for individual use as a jump rope, and the at least one weight is configured for individual use in weight lifting exercises.

9. The trainer of claim 1, wherein the bag includes an internal handle for transporting the at least one weight, the leash and the belt all within the bag.

10. The trainer of claim 9, wherein the bag comprises an aerodynamic tear-drop shape that conceals the internal handler, and a coupler that engages the leash to the bag during resistance exercise training.

11. The trainer of claim 1, wherein the at least one weight includes a low-impact filling.

12. The trainer of claim 11, wherein the low-impact filling comprises granules, pellets, or low-density beads.

13. The trainer of claim 11, wherein the weight includes a sealable compartment for selectively filling or emptying the low-impact filling.

14. The trainer of claim 13, wherein the compartment includes a sleeve.

15. A resistance exercise trainer, comprising:

a flexible belt wearable by a user;

a leash having a first end attached to the belt, and a second end; and a slidable bag attached to a second end of the leash, the slidable bag having a generally planar front surface and generally planar back surface, each having an exterior surface forming longitudinally extending channels/ ridges, and mesh webbing between opposite sides of the front surface and the back surface, the slidable bag being configured for removable reception of at least one weight;

wherein the front surface of the bag is folded over the back surface to define an interior of the bag in which the at least one weight may be disposed; and wherein the front surface and the back surface each include a tapered section disposed generally above the mesh webbing.

16. The trainer of claim 15, wherein the mesh webbing accommodates multiple weights disposed within the interior of the bag.

17. The trainer of claim 16, including at least one reinforcement patch attached to the bag for strengthening the mesh webbing.

18. The trainer of claim 16, including a quick-release mechanism coupled to the belt for selectively detaching the leash from the belt on-the-fly by the user as the bag is being pulled by the user during resistance exercise training.

19. The trainer of claim 16, wherein the bag includes an adjustable internal retainer for securing the at least one weight inside the bag.

20. The trainer of claim 16, wherein the bag includes an internal handle for transporting the at least one weight, the leash and the belt all within the bag, and wherein the bag comprises an aerodynamic tear-drop shape that conceals the internal handler, and a coupler that engages the leash to the bag during resistance exercise training.

* * * * *